US005203682A

United States Patent [19]

Inklebarger

[11] Patent Number: 5,203,682

[45] Date of Patent: Apr. 20, 1993

[54] INCLINED PRESSURE BOOST PUMP

[75] Inventor: Bobby A. Inklebarger, Claremore, Okla.

[73] Assignee: Baker Hughes Incorporated, Houston, Tex.

[21] Appl. No.: 755,034

[22] Filed: Sep. 4, 1991

[51] Int. Cl.[5] ..... F04B 39/12

[52] U.S. Cl. ..... 417/435; 417/252; 417/53

[58] Field of Search ..... 417/434, 435, 244, 257, 417/53

[56] References Cited

U.S. PATENT DOCUMENTS

| | | | |
|---|---|---|---|
| 1,669,668 | 5/1928 | Marshall . | |
| 2,034,790 | 3/1936 | Arutunoff . | |
| 2,492,141 | 12/1949 | Gaylord . | |
| 3,244,106 | 4/1966 | Gay | 417/244 |
| 4,693,271 | 9/1987 | Hargrove et al. . | |
| 4,924,898 | 5/1990 | Evenson | 417/244 |

FOREIGN PATENT DOCUMENTS

| | | | |
|---|---|---|---|
| 0017501 | 2/1979 | Japan | 417/435 |

OTHER PUBLICATIONS

T. J. B. Foote and J. P. Stalder, BP Exploration, Society of Petroleum Engineers, 1991.

*Primary Examiner*—Richard A. Bertsch
*Assistant Examiner*—Charles G. Freay
*Attorney, Agent, or Firm*—James E. Bradley

[57] ABSTRACT

A submersible pump assembly is mounted within a pressure vessel or jacket for use at the surface for an injection well. The jacket has an inlet which connects to a feed pump for supplying feed water under pressure. The motor, seal section and pump mount within the jacket, with a discharge conduit extending out a discharge end of the jacket. The support for the jacket inclines the jacket at an inclination relative to horizontal. This causes any gases in the feed water to migrate toward and accumulate at the upper end of the jacket. A bleed off valve is employed to bleed off the accumulation of gases.

19 Claims, 2 Drawing Sheets

INCLINED PRESSURE BOOST PUMP

BACKGROUND OF THE INVENTION

1. Field of the invention

This invention relates in general to pumps for injecting fluids into a well, and in particular to a multistage centrifugal pump.

2. Description of the Prior Art

In oil field applications, frequently, water must be pumped down an injection well. This may occur for disposal or for maintaining or increasing reservoir pressure in enhanced recovery operations. Various types of pumps are employed at the surface for injecting the water into the well at a high flow rate.

In one prior art type, a multistage centrifugal pump will be mounted horizontally at the surface adjacent the well. The centrifugal pump is of a type that normally would be utilized in a vertical application within a well for pumping fluid from the well. When used as an injection pump, however, the prior art centrifugal pump is driven by a conventional electrical motor.

A special thrust bearing locates at the end of the pump for handling the thrust due to the discharge of fluid from each of the impeller and diffuser stages. An intake chamber surrounds the intake of the pump. A feed pump will supply water under pressure from a tank to the intake chamber. While this type of pump works well, it requires some special components, such as the thrust bearing and intake chamber.

Also, if the feed pressure is high, a large differential will exist between the intake chamber and the atmosphere. The shaft extends out of the intake chamber into the atmospheric pressure. High pressure seals around the shaft are required. Sealing under high pressure around the rotating shaft is a problem. Consequently, these types of pumps are not very suitable for boosting a fairly high feed pressure to a higher pressure.

Another problem that can occur in horizontally mounted injection pumps results from gas contained in the feed fluid. Gas within the water detracts from the performance of the pump. Gas separators are used downhole when used as a well pump, but are not normally used on the surface for injection pumps.

Pumps have been installed in shallow vertical wells or sumps in the past for pressure boosting applications. In those instances, a liner is employed in the well. The liner has an open lower end surrounds the pump, seal section and motor. The liner forces fluid pumped by a feed source into the well to flow up around the motor to the intake of the pump. These assemblies require the expense of a well, and are more expensive to pull for maintenance than a horizontally mounted surface pump.

SUMMARY OF THE INVENTION

In this invention, the pump assembly of a conventional downhole centrifugal submersible pump is mounted within a jacket. This will include the motor, seal section and centrifugal pump. The jacket is of a type that will withstand pressure. It has an inlet which connects to the feed pump for receiving water under pressure. The submersible pump has a discharge conduit on its end which extends through a closed outlet end of the jacket. Consequently, the entire jacket will be under pressure that is approximately the pressure of the feed pump discharge.

Preferably, the jacket will be mounted to a support that inclines the jacket relative to horizontal. This inclination causes any gases contained within the feed water to migrate and collect at the outlet end of the jacket. A bleed off valve allows accumulated gases to be bled off from the outlet end of the jacket.

DETAILED DESCRIPTION OF THE INVENTION

Figure 1:
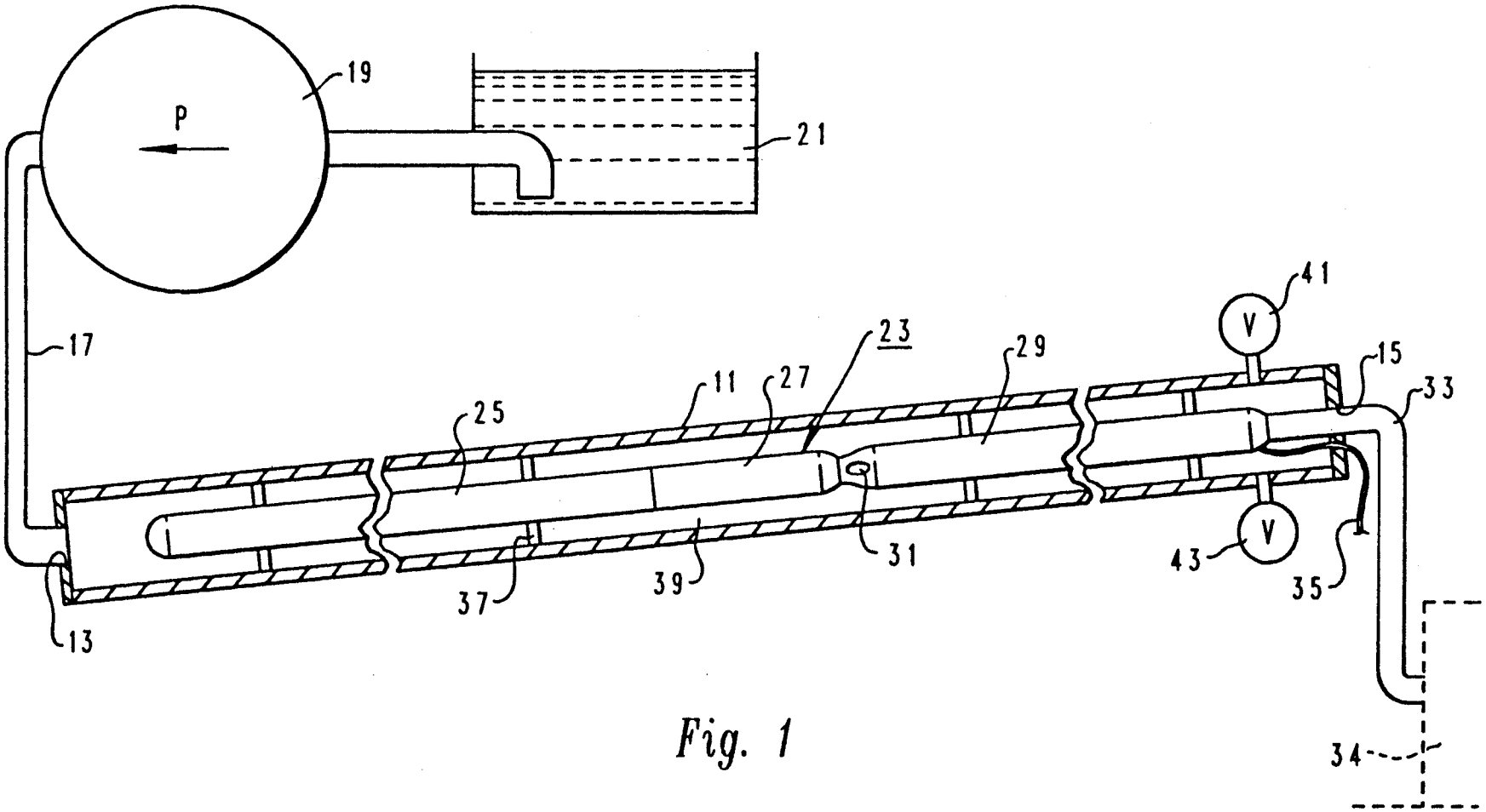
FIG. 1 is a schematic view illustrating an inclined pressure boost pump constructed in accordance with this invention.

Referring to FIG. 1, jacket 11 is a long tubular member, typically about 40 feet in length. Jacket 11 is cylindrical, and may be made up of casing of a type that is used for casing a well. A typical inner diameter of jacket 11 will be a little more than six inches.

Jacket 11 is a sealed pressure vessel. It has an inlet 13 in one end and a discharge end 15 on the opposite end. A feed conduit 17 connects a feed pump 19 to inlet 13. Feed pump 19 is of a conventional type, either centrifugal or reciprocating. Feed pump 19 has its intake connected with a source such as a tank 21 containing water.

An entire submersible pump assembly 23 is mounted inside jacket 11. Submersible pump assembly 23 is of a conventional type that is normally employed downhole in a well in a vertical application. Submersible pump assembly 23 has a submersible electrical motor 25 that is of an alternating current type. Motor 25 has a shaft that extends through a seal section 27 which contains thrust bearings. Seal section 27 also has a diaphram (not shown) exposed to pressure in the interior of the jacket 11 for equalizing pressure of the lubricating oil in the motor 25 with the pressure in the jacket 11. Seal section 27 connects to a centrifugal pump 29. Centrifugal pump 29 has a large number of stages, each stage having a diffuser and a rotating impeller.

Centrifugal pump 29 has an intake 31 that is located at its lower end immediately above the upper end of seal section 27. Pump intake 31 is located approximately half way along the length of jacket 11. The discharge of pump 29 connects to a discharge conduit 33. Discharge conduit 33 extends sealingly through the closed discharge end 15. Consequently, the discharge fluid does not communicate with the interior of jacket 11. Rather, the discharge fluid flows out the discharge conduit 33 to a well 34. Thrust due to the discharge is transmitted to the housing of pump 29 and reacted through the discharge conduit 33 and closed discharge end 15 of jacket 11.

A power cable 35 extends through a sealed entry area in the discharge end 15. Power cable 35 supplies power from an AC power source to motor 25. The submersible pump assembly 23 mounts within the jacket 11 on a plurality of centralizers 37. Centralizers 37 support the submersible pump assembly 23 so that its longitudinal axis coincides with the longitudinal axis of the jacket 11. The outer diameter of centrifugal pump 29 is less than the inner diameter of jacket 11. This results in an annular clearance 39. The clearance 39 is greatly exaggerated in FIG. 1. In practice, it likely will be only about ⅛th of an inch. The centralizers 37 have passages so as to allow well fluid to flow from inlet 13 and around the motor 25 and seal section 27 to the intake 31.

A bleed off valve 41 locates near the discharge end 15 of the pump. Bleed off valve 41 is located on the upper side of jacket 11. Because the discharge end 15 is higher than the inlet 13, any gas contained within the feed water 19 would tend to migrate toward and collect at the discharge end 15 in the space surrounding the discharge conduit 33. Bleed off valve 41 allows this gas to be periodically bled off. Bleed off valve 41 can comprise a manual valve connected with a port to communicate the interior of jacket 11 to the exterior. Alternately, bleed off valve 41 could comprise an automatic type utilizing a float which triggers the release of gas when the water level drops.

Also, a pressure relief valve 43 is employed with jacket 11. Pressure relief valve 43 is set to relieve pressure in the interior jacket 11 if the pressure exceeds a selected maximum. Pressure relief valve 43 will be of a conventional type.

The jacket 11 is preferably mounted at an inclination of about nine degrees relative to horizontal. The amount of inclination is selected to be sufficient to cause gas at the inlet 13 to migrate toward and collect in the jacket 11 at the discharge end 15. Preferably, the inclination is not so great however, so as to place the discharge end 15 beyond reach of a worker standing on the ground. In a typical installation, a nine degree inclination allows the worker to have access to the bleed off valve 41 without the need for steps or a ladder.

Figure 3:
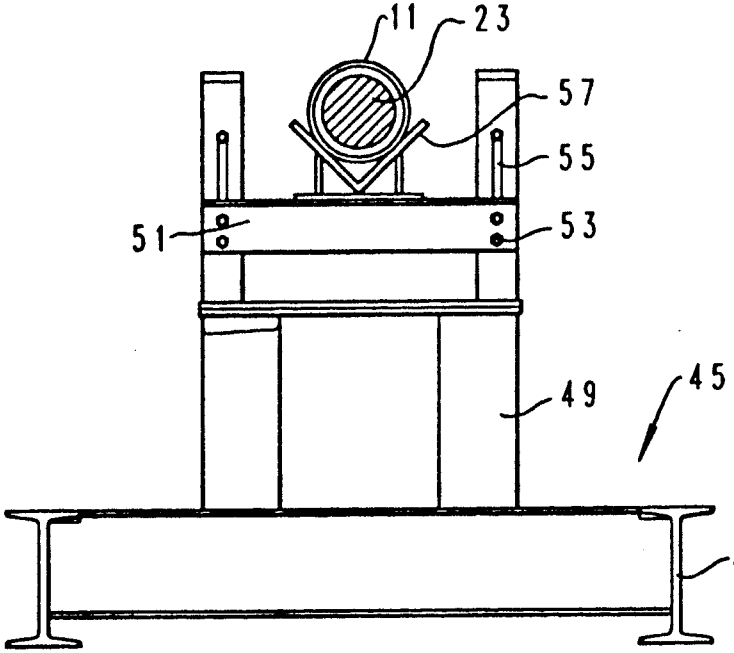
FIG. 3 is a sectional view of, the assembly shown in FIG. 2, taken along the line III—III of FIG. 2.
Figure 2:
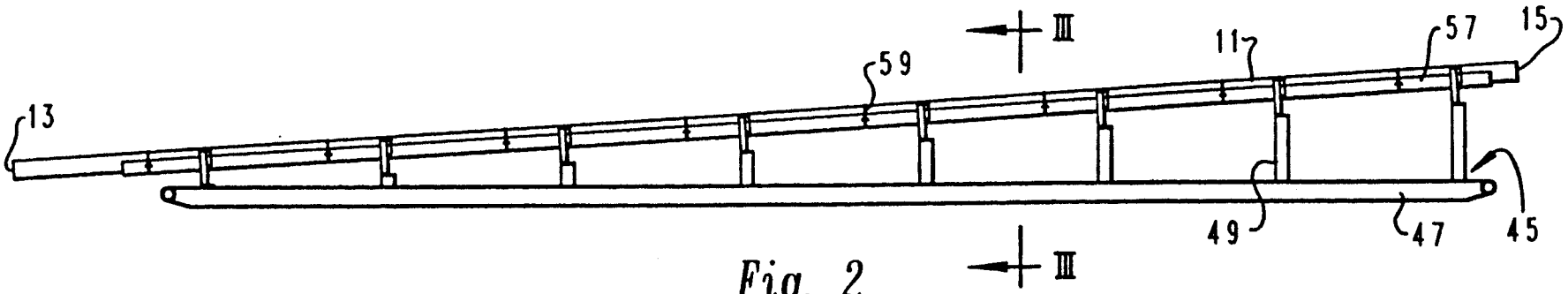
FIG. 2 illustrates the pump assembly of FIG. 1 mounted to an inclined support.

FIG. 2 illustrates a mounting system or support 45 for supporting jacket 11 at the desired inclination. Support 45 is mounted to a skid 47 that allows the assembly to be skidded into place. Legs 49 extend upward from skid 47. The legs 49 incrementally increase in height from one end to the other end. As shown in FIG. 3, braces 51 extend between upper sections of each of the legs. Braces 51 can also be adjusted for vertical elevation. Fasteners 53 will engage slots 55 in the upper sections of legs 49. This enables the braces 51 to be placed at selected elevations.

A V-shaped trough 57 extends the length of the skid 47. Trough 57 is supported on the braces 51. The jacket 11 is supported on the trough 57. Straps 59 are employed along the length to strap the jacket 11 to the trough 57.

In operation, referring to FIG. 1, feed pump 19 will pump water from tank 21 into jacket inlet 13. A typical pressure is about 2,500 PSI. The feed pressure could be as low as 100 PSI, and possibly as high as 5,000 PSI, depending upon the strength of jacket 11.

The water will flow into the interior of jacket 11, pressurizing jacket 11 to a pressure that is approximately the same as the discharge pressure of feed pump 19. Electrical power is supplied to motor 25. Motor 25 will rotate the shaft (not shown) contained within centrifugal pump 29. The pump will draw fluid in intake 31 and pump it out the discharge conduit 33 at a higher pressure. Typically, the discharge pressure of pump 29 will be around 3,900 to 4,300 PSI with an intake pressure of 2500 PSI. The discharge pressure could be as high as 6,000 PSI. The water flows out the discharge conduit 33 into well 34.

Any gases contained in the water will tend to migrate toward the discharge end 15. This gas will tend to accumulate in the annular space surrounding the discharge conduit 33. Periodically, a maintenance worker may open bleed off valve 41 to bleed off gases that have collected in jacket 11. If an automatic bleed off valve is employed, the automatic valve will bleed off gases once the accumulation causes the float (not shown) within the bleed off valve 41 to trigger the release of gas. If excessive feed pressure occurs from feed pump 19, pressure relief valve 43 will relieve the internal pressure within jacket 11.

The invention has significant advantages Locating an entire submersible pump assembly including the motor within a jacket allows more standard components to be utilized for surface applications than with prior art horizontal injection pumps. No special thrust bearings or intake chambers are necessary. The jacket can be easily constructed of casing that will normally be available. The inclination of the jacket tends to avoid the accumulation of gases in the area of intake 31, which could otherwise cause gas locking of the pump.

While the invention has been shown in only one of its forms, it should be apparent to those skilled in the art that it is not so limited, but is susceptible to various changes without departing from the scope of the invention.

I claim:

1. An apparatus for supporting an electrical submersible pump assembly for boosting pressure of liquid delivered under feed pressure from a feed source, the submersible pump assembly comprising an electrical motor and a centrifugal pump having an intake, the apparatus comprising in combination:

a tubular jacket capable of containing the feed pressure, the jacket having an inlet on one end adapted to be connected to the feed source, the jacket having a discharge end opposite the inlet;

motor mounting means for mounting the electrical motor and intake of the centrifugal pump within the jacket, with the discharge end of the jacket being upstream of the intake of the pump;

gas accumulation means for accumulating gas contained in the liquid supplied from the feed source during operation of the pump in the jacket upstream of the intake of the pump at the discharge end of the jacket; and bleed off means at the discharge end of the jacket for bleeding off any accumulation of gases.

2. An apparatus for supporting an electrical submersible pump assembly for boosting pressure of fluid delivered under feed pressure from a feed source, the submersible pump assembly comprising an electrical motor and a centrifugal pump having an intake, the apparatus comprising in combination:

a tubular jacket capable of containing the feed pressure, the jacket having an inlet on one end adapted to be connected to the feed source, the jacket having a discharge end opposite the inlet;

the electrical motor and intake of the centrifugal pump adapted to be located within the jacket, with the discharge end of the jacket being upstream of the intake of the pump;

gas accumulation means for accumulating gas in the jacket upstream of the intake of the pump at the discharge end of the jacket;

bleed off means at the discharge end of the jacket for bleeding off any accumulation of gases; and wherein the gas accumulation means comprises:

mounting means for mounting the jacket at an inclination relative to horizontal with the discharge end of the jacket at a higher elevation than the inlet of the jacket.

3. The apparatus according to claim 1 wherein the motor mounting means locates the electrical motor downstream of the inlet of the jacket and locates the intake of the pump downstream from the electrical motor for causing the pump to draw the liquid from the inlet past the motor.

4. The apparatus according to claim 1 wherein the motor mounting means locates the electrical motor downstream of the inlet of the jacket and locates the intake of the pump downstream from the electrical motor, the motor mounting means further comprising:

centralizer means for supporting the centrifugal pump above a lower wall of the jacket for causing the pump to draw the liquid from the inlet past the motor.

5. The apparatus according to claim 1, further comprising:

conduit means for connecting the discharge end of the jacket to a well for pumping down the well liquid delivered under feed pressure from the feed source; and jacket mounting means for mounting the jacket adjacent the well.

6. An apparatus for supporting an electrical submersible pump assembly for pumping down a well fluid delivered under feed pressure from a feed source, the submersible pump assembly comprising an electrical motor and a centrifugal pump connected to a discharge conduit, the apparatus comprising in combination:

a tubular jacket capable of containing the feed pressure, the jacket having an inlet on one end adapted to be connected to the feed source, the jacket having a discharge end opposite the inlet;

the jacket having a length greater than the length of the submersible pump assembly and an inner diameter greater than the outer diameter of any portion of the submersible pump assembly for receiving the motor and centrifugal pump within the jacket, with a pump intake in the jacket and the discharge conduit adapted to extend sealingly through the discharge end of the jacket for coupling to the well;

mounting means for mounting the jacket adjacent the well at an inclination relative to horizontal with the discharge end of the jacket at a higher elevation than the inlet of the jacket, allowing gases that may be contained in the fluid delivered from the feed source to migrate toward and accumulate at the discharge end of the jacket; and bleed off means at the discharge end of the jacket for bleeding off any accumulation of gases.

7. The apparatus according to claim 6 wherein the bleed off means comprises a port extending through the jacket on an upper side of the jacket adjacent the discharge end of the jacket, and a valve connected with the port for allowing gases trapped in the jacket at the port to flow out of the port.

8. The apparatus according to claim 6, further comprising:

centralizer means for supporting the pump from contact with a lower portion of the inner diameter of the jacket.

9. The apparatus according to claim 6, further comprising:

pressure relief means in the jacket for relieving the jacket of feed pressure should the feed pressure exceed a selected maximum.

10. An apparatus for pumping down a well fluid delivered under feed pressure from a feed source, comprising in combination:

a tubular jacket capable of containing the feed pressure, the jacket having an inlet on one end adapted to be connected to the feed source, the jacket having a discharge end opposite the inlet;

an electrical submersible pump assembly comprising an electrical motor mounted in the jacket and coupled to a centrifugal pump, the centrifugal pump having an intake in the jacket upstream of the discharge end of the jacket; and mounting means for mounting the jacket adjacent the well at an inclination relative to horizontal with the discharge end of the jacket at a higher elevation than the inlet of the jacket, allowing gases that may be contained in the fluid delivered from the feed source to migrate past the intake of the pump and accumulate at the discharge end of the jacket.

11. The apparatus according to claim 10 further comprising:

a discharge conduit mounted to a discharge of the pump, the discharge conduit extending sealingly through the discharge end of the jacket.

12. The apparatus according to claim 10 further comprising:

means at the discharge end of the jacket for bleeding off any accumulation of gases.

13. The apparatus according to claim 10, further comprising:

centralizer means for supporting the pump above a lower wall of the jacket.

14. The apparatus according to claim 10, further comprising:

pressure relief means in the jacket for relieving the jacket of feed pressure should the feed pressure exceed a selected maximum.

15. An apparatus for pumping fluid down a well, comprising in combination:

a feed pump having an intake connected to a source of the fluid and an outlet for pumping the fluid out the outlet at a selected feed pressure;

a tubular jacket capable of containing the feed pressure, the jacket having an inlet on one end connected to the feed pump, the jacket having a discharge end opposite the inlet;

an electrical submersible pump assembly contained within the jacket, the submersible pump assembly comprising an electrical motor coupled to a centrifugal pump, the centrifugal pump having an intake in the jacket and being connected to a discharge conduit extending sealingly through the discharge end of the jacket, the discharge conduit being adapted to be coupled to the well;

mounting means for mounting the jacket adjacent the well at an inclination relative to horizontal with the discharge end of the jacket at a higher elevation than the inlet of the jacket, allowing gases that may be contained in the fluid delivered from the feed pump to migrate past the intake of the pump and accumulate in the jacket at the discharge end of the jacket and exterior of the discharge conduit; and means at the discharge end of the jacket for bleeding off any accumulation of gases.

16. The apparatus according to claim 15, further comprising:

centralizer means for supporting the pump above a lower wall of the jacket.

17. A method for boosting pressure of a liquid supplied form a feed source, comprising:

providing a tubular jacket having an inlet and a discharge end;

mounting within the jacket an electrical motor coupled to a centrifugal pump, with the centrifugal pump having an intake located within the jacket;

supplying the liquid from the feed source at a selected feed pressure to the inlet of the jacket, thereby pressurizing the jacket to the feed pressure;

drawing the liquid in the jacket into the intake of the centrifugal pump and pumping the liquid with the centrifugal pump out the exterior of the jacket;

migrating any gases contained in the liquid past the intake of the pump to the discharge end of the jacket exterior of the pump; and bleeding off the gases that accumulate at the discharge end of the jacket.

18. A method for boosting pressure of a fluid supplied from a feed source, comprising:

providing a tubular jacket having an inlet and a discharge end;

mounting within the jacket an electrical motor coupled to a centrifugal pump, with the centrifugal pump having an intake located within the jacket;

supplying the fluid from the feed source at a selected feed pressure to the inlet of the jacket, thereby pressurizing the jacket to the feed pressure;

drawing the fluid in the jacket into the intake of the centrifugal pump and pumping the fluid with the centrifugal pump out the exterior of the jacket;

migrating any gases contained in the fluid past the intake of the pump to the discharge end of the jacket exterior of the pump;

bleeding off the gases that accumulate at the discharge end of the jacket; and wherein the step of migrating the gases comprises:

mounting the jacket at an inclination relative to horizontal, with the discharge end of the jacket at a higher elevation than the inlet of the jacket.

19. The method according to claim 17 wherein the step of bleeding off accumulated gases at the discharge end of the jacket comprises periodically opening a valve located at the discharge end of the jacket; and wherein the step of mounting the electrical motor and pump within the jacket comprises locating the intake of the pump downstream from the motor and upstream from the discharge end of the jacket, so that the step of drawing the liquid into the intake of the pump causes the liquid to flow past the electrical motor to the intake of the pump.

* * * * *